US010745866B2

(12) United States Patent
Berglund

(10) Patent No.: US 10,745,866 B2
(45) Date of Patent: Aug. 18, 2020

(54) TIE PLATE PICKER

(71) Applicant: Tienergy LLC, Gilberts, IL (US)

(72) Inventor: Steve Berglund, Elgin, IL (US)

(73) Assignee: TIENERGY LLC, Gilberts, IL (US)

( * ) Notice: Subject to any disclaimer, the term of this patent is extended or adjusted under 35 U.S.C. 154(b) by 317 days.

(21) Appl. No.: 15/908,939

(22) Filed: Mar. 1, 2018

(65) Prior Publication Data

US 2018/0274181 A1 Sep. 27, 2018

Related U.S. Application Data

(60) Provisional application No. 62/475,697, filed on Mar. 23, 2017.

(51) Int. Cl.
*E01B 29/32* (2006.01)
*E01B 29/24* (2006.01)

(52) U.S. Cl.
CPC ..... *E01B 29/32* (2013.01); *E01B 29/24* (2013.01)

(58) Field of Classification Search
CPC ..... E01B 29/09; E01B 29/24; E01B 29/32
USPC ..... 104/16
See application file for complete search history.

(56) References Cited

U.S. PATENT DOCUMENTS

| | | | | | |
|---|---|---|---|---|---|
| 3,135,223 | A * | 6/1964 | Plasser | E01B 27/17 | 104/7.1 |
| 3,675,580 | A * | 7/1972 | Kershaw | E01B 29/10 | 104/9 |
| 3,881,422 | A * | 5/1975 | Bryan, Jr. | E01B 29/09 | 104/9 |
| 4,018,165 | A * | 4/1977 | Bryan, Jr. | E01B 29/09 | 104/9 |
| 4,096,806 | A * | 6/1978 | Allmer | B06B 1/18 | 104/10 |
| 5,063,856 | A * | 11/1991 | Theurer | E01B 29/32 | 104/7.1 |
| 5,277,122 | A * | 1/1994 | Almaraz | E01B 29/32 | 104/17.2 |
| 5,617,795 | A * | 4/1997 | Glomski | E01B 29/10 | 104/9 |
| 7,258,069 | B1 * | 8/2007 | Cotsford | E01B 29/14 | 104/2 |
| 7,497,166 | B2 * | 3/2009 | Fuerst | E01B 29/32 | 104/16 |
| 8,739,704 | B2 * | 6/2014 | Wickman | E01B 29/10 | 104/2 |
| 10,526,753 | B2 * | 1/2020 | Hamilton | E01B 29/32 | |
| 2016/0289899 | A1 * | 10/2016 | Hamilton | E01B 29/32 | |
| 2018/0223482 | A1 * | 8/2018 | Hamilton | E01B 29/32 | |
| 2018/0274181 | A1 * | 9/2018 | Berglund | E01B 29/32 | |
| 2019/0119861 | A1 * | 4/2019 | Hamilton | E01B 29/32 | |

* cited by examiner

*Primary Examiner* — Zachary L Kuhfuss
(74) *Attorney, Agent, or Firm* — Hahn Loeser & Parks LLP

(57) ABSTRACT

A tie plate picker for extracting tie plates from ties such as railroad cross ties. Pistons driving arms are arranged to be moving in directions toward a vertical center line when they are extending out of cylinders.

18 Claims, 5 Drawing Sheets

TIE PLATE PICKER

The present application claims the benefit of the filing date of U.S. Ser. No. 62/475,697, filed 23 Mar. 2017 and titled Tie Plate Picker.

There is a need for a fast, safe, and efficient way to extract tie plates from ties such as railroad cross ties. In the past, this has been done using a large pickle fork or a pry bar. They are both labor intensive and inefficient, and are not practical except when removing small quantities of tie plates.

In general, a tie plate is a steel plate used between a railroad rail and a cross tie. It increases the weight bearing area on the tie and maintains the gauge of the railroad track. Tie plates typically are fastened to ties (often wooden ties) by spikes or bolts through holes in the tie plates, and typically edges of a flanged T rail fit against shoulders on top surfaces of the tie plates.

BRIEF DESCRIPTION OF THE DRAWINGS

The following drawings illustrate the concepts of the present invention. Illustrations of an exemplary device are not necessarily drawn to scale.

DETAILED DESCRIPTION

Figure 1:
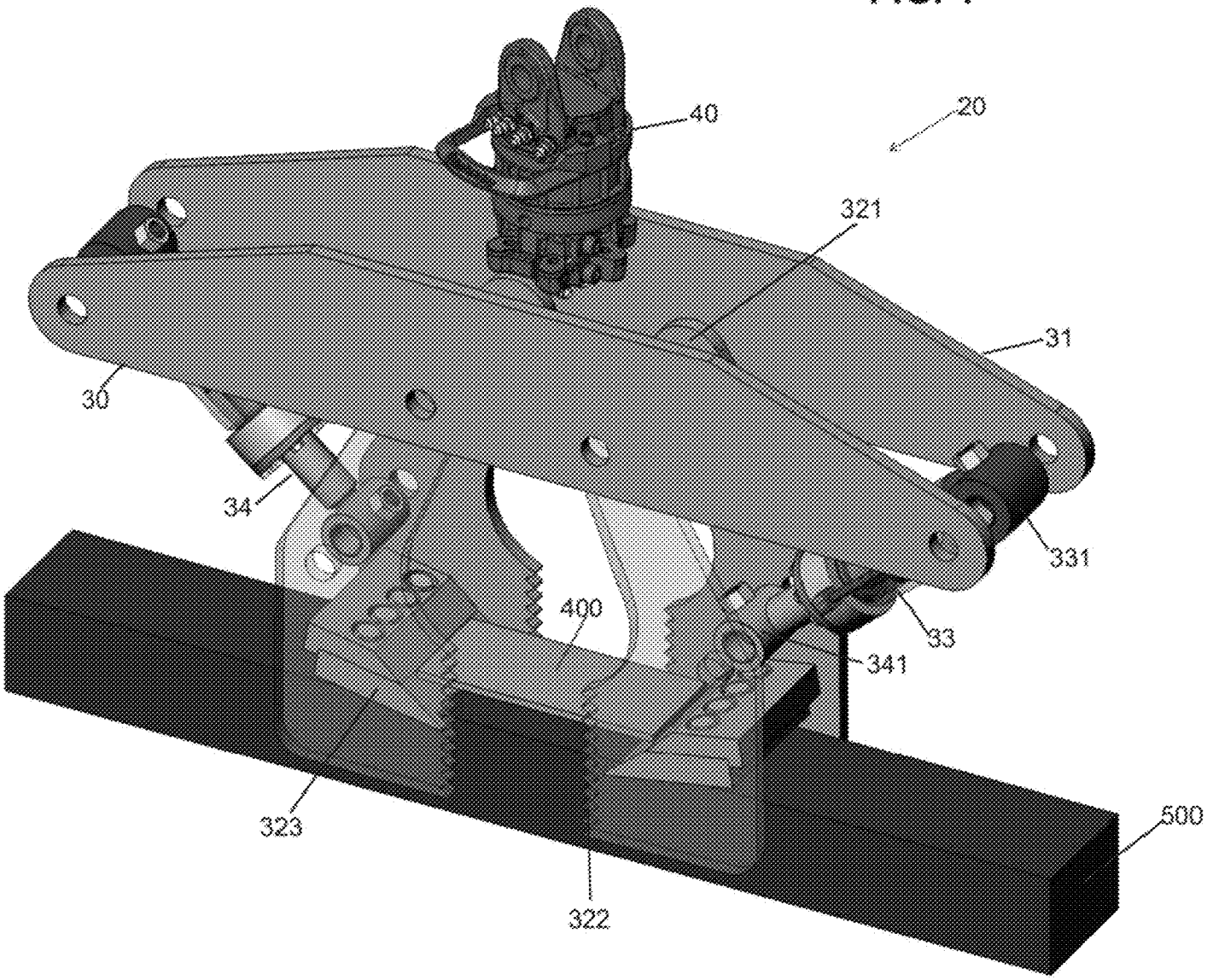
FIG. 1 is a perspective view of one embodiment of a grapple comprising an exemplary tie plate picker, also illustrating a generic tie and a generic tie plate in situ.

While the embodiments of this invention can take many different forms, specific embodiments thereof are illustrated in the drawings and will be described herein with the understanding that the present disclosure is to be considered an exemplification of the principles of the invention, and is not intended to limit the invention to a specific embodiment illustrated.

FIGS. 1-4 illustrate an exemplary embodiment of a grapple 20 comprising a tie plate picker 30. The tie plate picker 30 comprises a grapple head 31, two arms 32, two cylinders 33, and two pistons 34.

The grapple head 31 extends in two opposite directions from a vertical center line 100, and those directions and the vertical center line 100 define a plane of operation. The arms 32 and the cylinders 33 rotate, and the pistons 34 extend and retract, in directions that are substantially parallel to the plane of operation.

Each of the two arms 32 pivotally depends from the grapple head 31 about a respective arm pivot 321, and each of the two cylinders 33 pivotally depends from the grapple head 31 about a respective cylinder pivot 331. As best seen in FIG. 1, the grapple head 31 of this embodiment comprises substantially parallel plates with the arms 32 and the cylinders 33 pivotally depending from the grapple head 31 between the two plates of the grapple head 31.

Figure 2:
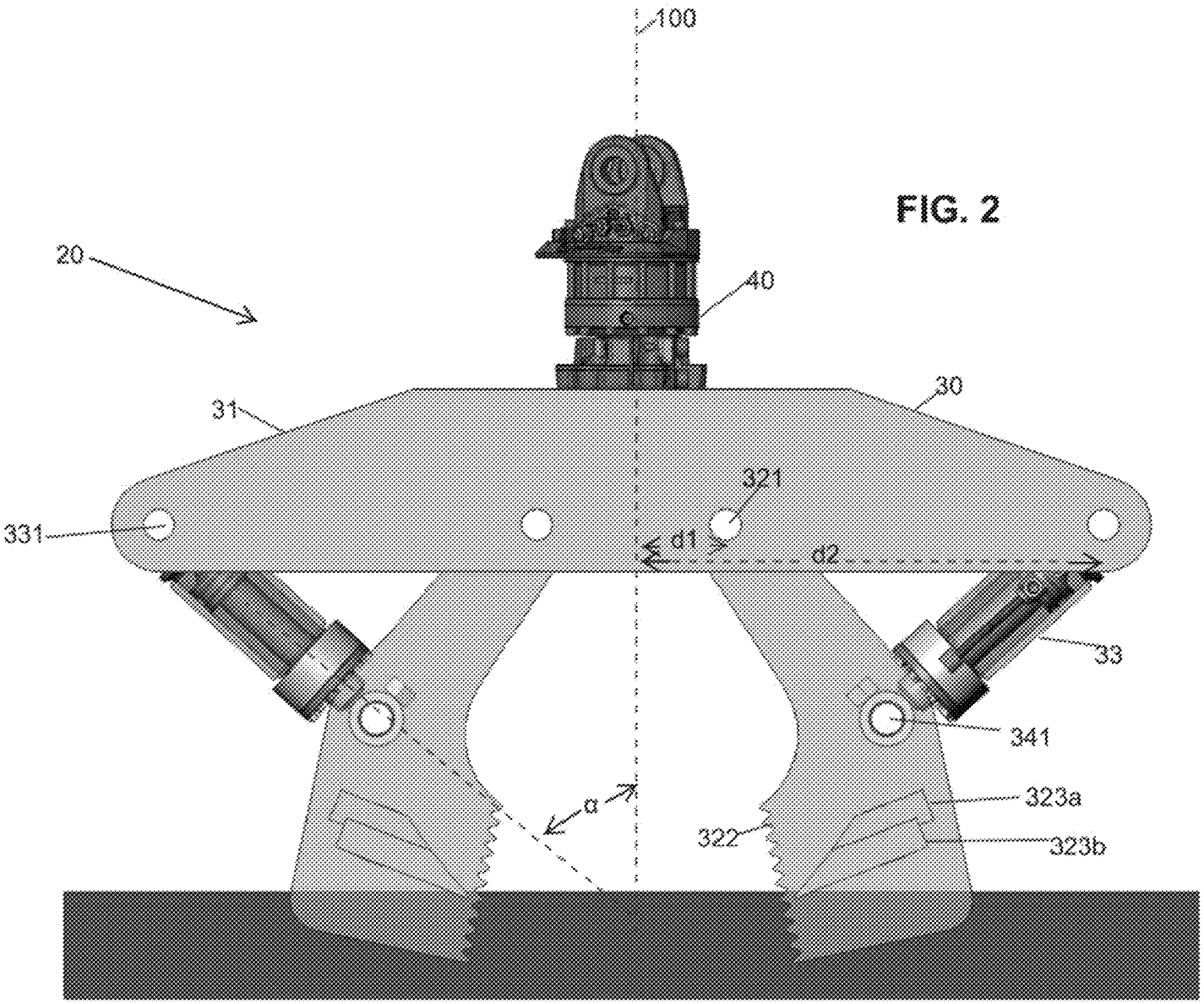
FIG. 2 is a front view of the embodiment of FIG. 1, with the arms in an open position.
Figure 3:
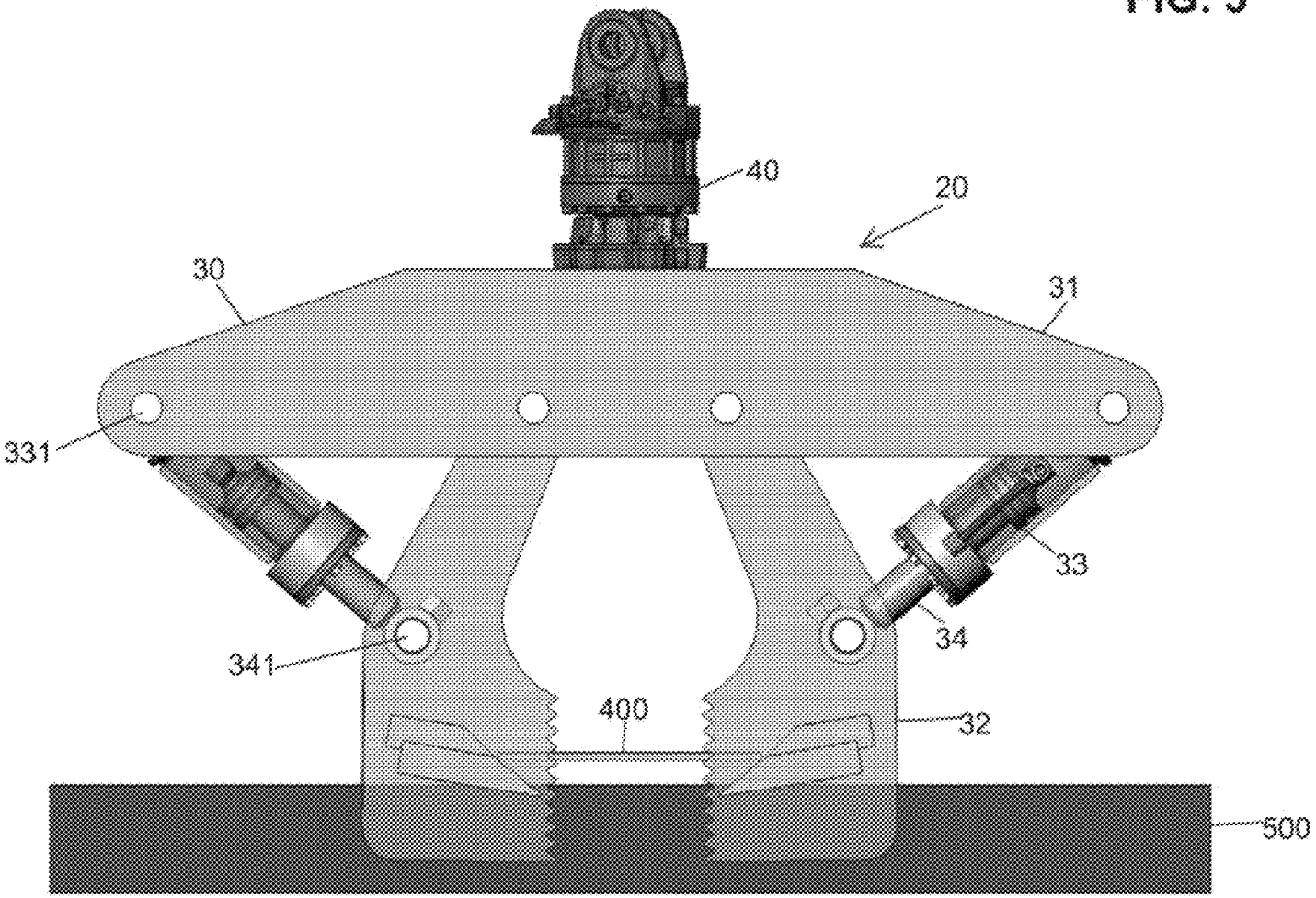
FIG. 3 is a front view of the embodiment of FIG. 1, with the arms in a position engaging the tie plate.
Figure 4:
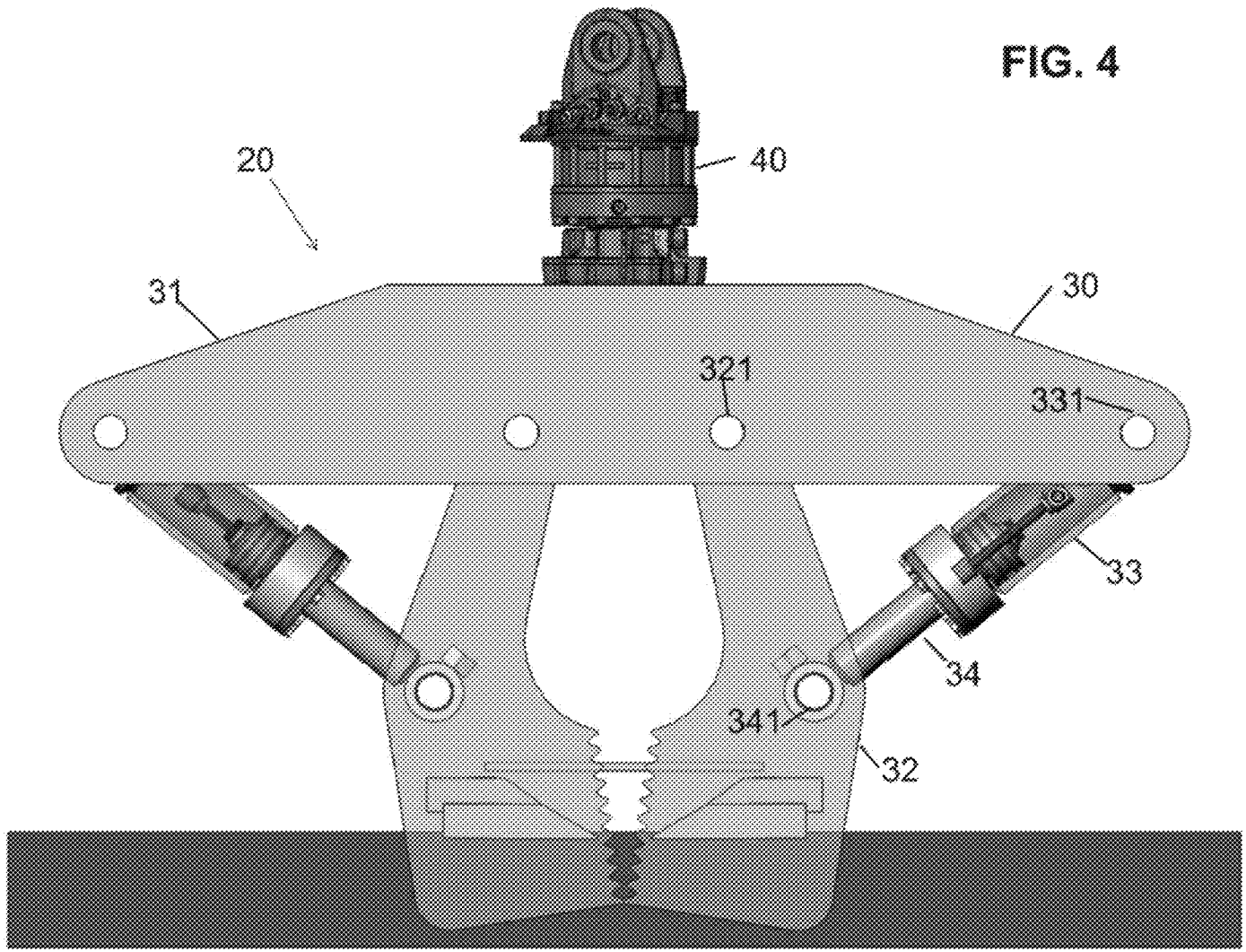
FIG. 4 is a front view of the embodiment of FIG. 1, with the arms in a closed position.

Each of the two pistons 34 is movably located within a respective one of the two cylinders 33, and can extend out from or retract in toward the cylinder 33 at an end of the cylinder 33 opposite the end of the cylinder 33 that is pivotally connected to the grapple head 31. FIGS. 2-4 show the pistons 34 at different positions of extension. As an example, the pistons can be hydraulically actuated (hydraulic hoses not shown), but other actuation means such as other mechanical or pneumatic means could be used in other examples.

A pivot end of the piston 34 is pivotally connected to a respective arm 32 about a piston pivot 341, so that the arms 32 close towards the vertical center line 100 when the pistons 34 extend out of the cylinders 33.

A wedge-shaped knife 323 is located in a lower portion of each arm 32, with the tapered, thin edge of the knife 323 being that part of the knife 323 that is closest to vertical center line 100. As best seen in FIG. 1, the arms of this embodiment comprise substantially parallel plates with each of the knives 323 being situated between the two plates of a respective arm 32. In practice, the tie plate picker 30 is positioned over a railroad tie 500 on which a tie plate 400 is fastened. As the arms 32 are closed, typically with the plates of the arms 32 partially straddling the tie 500, the wedge shaped knives 323 move under the ties plate 400 and extract the tie plate 400 off of the tie 500. The tapered, thin edge of the knife 323 leads. The tie plate 400 rides up the incline of the wedge-shaped knives 323, while the tie 500 remains below the knives 323. This is illustrated progressively in FIGS. 2-4. In some examples, a knife 323 comprises a permanent upper portion 323*a*, and a replaceable lower portion 323*b* that may, for example, be bolted to the permanent upper portion 323*a*. In that way, the replaceable lower portion 323*b*, which is more likely to get worn, can be replaced as necessary.

It is effective if the pistons 34 can drive the arms 32 with enough energy to propel the knives 323 under the tie plate 400 and extract the tie plate fasteners or, if necessary, shear them off. To accomplish this end efficiently, the pistons 34 always should being moving in directions toward the vertical center line 100 when they are extending out of the cylinders 33. This depends on the locations of the arm pivots 321, the cylinder pivots 331, and the piston pivots 341 relative to each other.

For example, a distance d2 between a cylinder pivot 331 and the vertical center line 100 can be greater than a distance d1 between an arm pivot 321 and the vertical center line 100: at least twice as long in some examples, at least three times as long in some examples, at least four times as long in some examples, and at least five times as long in some examples.

For example, an interior angle $\alpha$ between the vertical center line 100 and a direction that the piston 34 moves, when it extends out of the cylinder 33 and towards the vertical center line 100, should always be at least 30° in some examples, at least 40° in some examples, at least 45° in some examples, and at least 60° in some examples.

Once a tie plate 400 is extracted from a tie 500, the arms 32 can be used to lift and remove the tie plate 400, sometimes by rotating the tie plate picker 30 relative to the tie 500 as discussed below. Adding an uneven surface 322 to an inner side of the lower portion of the arms 32 facilitates that use of the arms 32. In the illustrated example, an inner side of each of the plates of the arms 32 comprises an edge with uneven surface 322. The uneven surface 322 may comprise, for example, teeth, a corrugated surface, a sawtooth surface, a grooved surface, a knurled surface, and so forth.

The exemplary grapple 20 comprises the tie plate picker 30 suspended from a rotator 40 that allows the plane of operation to rotate about the vertical center line 100. Using the rotator 40, it is easier to align the plane of operation with a longitudinal axis of a tie 500 for extraction of a tie plate 400. It also is easy then to rotate the plane of operation in order to close the arms 32 on the longer sides of a tie plate 400, and to use the uneven surfaces 322 to facilitate lifting and removing a tie plate 400.

Figure 5:
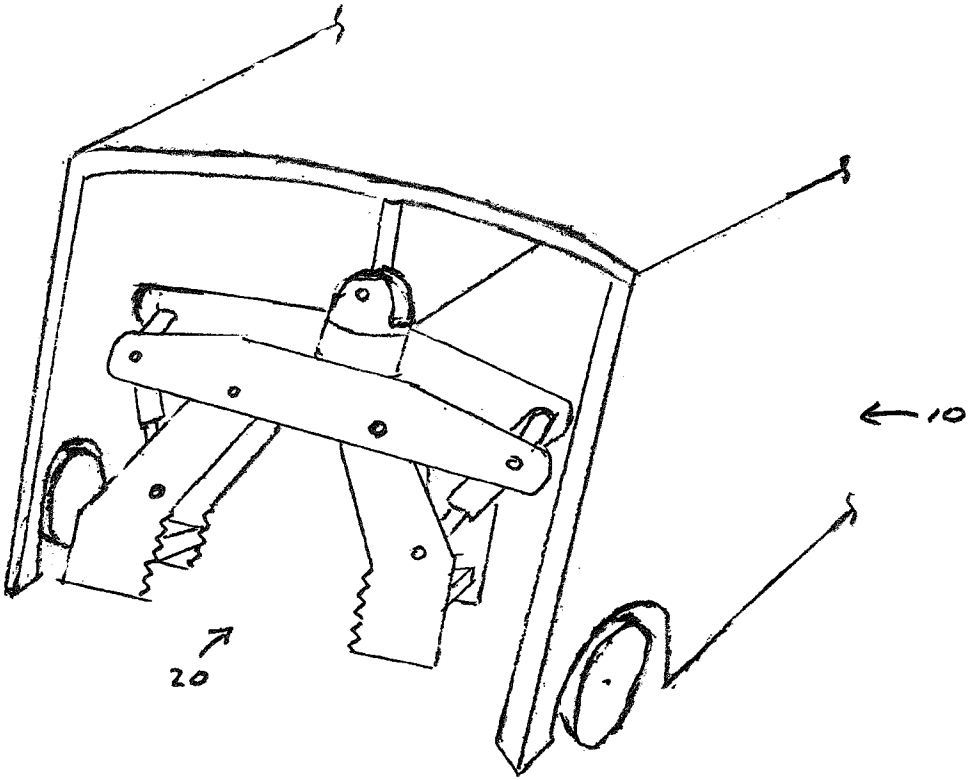
FIG. 5 is a perspective view of a generic wheeled vehicle comprising the grapple of FIG. 1.

FIG. 5 illustrates a generic wheeled vehicle 10 comprising an exemplary grapple 20. Mounting an exemplary grapple 20 on or as part of a vehicle 10 facilitates moving the tie plate picker 30 over the tie plates 400 to be extracted, such as along a railroad track.

From the foregoing, it will be understood that numerous modifications and variations can be effectuated without departing from the true spirit and scope of the novel concepts of the present invention. It is to be understood that no limitation with respect to the specific embodiments illustrated and described is intended or should be inferred.

What is claimed is:

1. A tie plate picker comprising:

a grapple head, extending in two opposite directions from a vertical center line, the two opposite directions and the vertical center line defining a plane of operation;

two arms, each of the two arms pivotally depending from the grapple head about respective arm pivots, allowing the two arms to rotate in directions substantially parallel to the plane of operation;

two cylinders, each of the two cylinders having a first end and an opposing second end, each of the two cylinders pivotally depending from the grapple head about respective cylinder pivots, allowing the two cylinders to rotate in directions substantially parallel to the plane of operation, the cylinder pivot of each one of the respective cylinders being located generally at the first end of the respective cylinder; and two pistons, each of the two pistons moveably located within a respective one of the two cylinders, allowing a pivot end of each of the two pistons to extend out from and to retract in toward the second end of the respective one of the two cylinders, the pivot end of each of the pistons being pivotally connected to a respective one of the two arms about respective piston pivots;

wherein the arm pivots, the cylinder pivots, and the piston pivots are arranged relative to each other so that, when the pivot ends of the two pistons are extending out from the second ends of the respective cylinders, each of the two arms rotates in directions toward the vertical center line and the pivot end of each of the two respective pistons always moves in directions toward the vertical center line;

and wherein a distance between one of the cylinder pivots and the vertical center line is at least twice as on as a distance between one of the arm pivots and the vertical center line.

2. The tie plate picker of claim 1, wherein a distance between one of the cylinder pivots and the vertical center line is at least three times as long as a distance between one of the arm pivots and the vertical center line.

3. The tie plate picker of claim 1, wherein a distance between one of the cylinder pivots and the vertical center line is at least four times as long as a distance between one of the arm pivots and the vertical center line.

4. The tie plate picker of claim 1, wherein a distance between one of the cylinder pivots and the vertical center line is at least five times as long as a distance between one of the arm pivots and the vertical center line.

5. The tie plate picker of claim 1, wherein an interior angle between the vertical center line and a direction, that the pivot end of a piston moves toward the vertical center line, is always at least $30^{0}$ when the pivot end is extending out from the second end of the respective cylinder.

6. The tie plate picker of claim 1, wherein an interior angle between the vertical center line and a direction, that the pivot end of a piston moves toward the vertical center line, is always at least $34^{0}$ when the pivot end is extending out from the second end of the respective cylinder.

7. The tie plate picker of claim 1, wherein an interior angle between the vertical center line and a direction, that the pivot end of a piston moves toward the vertical center line, is always at least 45' when the pivot end is extending out from the second end of the respective cylinder.

8. The tie plate picker of claim 1, wherein an interior angle between the vertical center line and a direction, that the pivot end of a piston moves toward the vertical center line, is always at least $60^{0}$ when the pivot end is extending out from the second end of the respective cylinder.

9. The tie plate picker of claim 1, wherein at least one of the two arms comprises an upper portion and a lower portion, the respective arm pivot being located in the upper portion, and the lower portion being located further than the upper portion is located from the grapple head, the lower portion having an inner side and an outer side, the inner side being closer than the outer side to the vertical center line, and the inner side comprising an edge with an uneven surface.

10. The tie plate picker of claim 1, wherein the cylinders are hydraulic cylinders and the pistons are hydraulically actuated.

11. A grapple comprising the tie plate picker of claim 1.

12. A wheeled vehicle comprising the grapple of claim 11.

13. A tie plate picker comprising:

a grapple head extending in two, opposite directions from a vertical center line the two opposite directions and the vertical center line defining a plane of operation;

two arms, each of the two arms pivotally depending from the grapple head about respective arm pivats allowing the two arms to rotate in directions substantially parallel to the plane of operation;

two cylinders, each of the two cylinders having a first end and an opposing second end, each of the two cylinders pivotally depending from the grapple head about respective cylinder pivots, allowing the two cylinders to rotate n directions substantially parallel to the plane of operation, the cylinder pivot of each one of the respective cylinders being located generally at the first end of the respective cylinder; and two pitons, each of the two pistons moveably located within a respective one of the two cylinders, allowing a pivot end of each of the two pistons to extend out from and to retract in toward the second end of the respective one of the two cylinders, the pivot, end of each of the pistons being pivotally connected to a respective one of the two arms about respective piston pivots;

wherein the arm pivots, the cylinder pivots, and the piston pivots are arranged relative to each other so that when the pivot ends of the two pistons are extending out from the second ends of the respective cylinders, each of the two arms rotates in directions to a d the vertical center line and the pivot end of each of the two respective pistons always moves in directions toward the vertical center line;

wherein at least one of the two arms comprises, an upper portion and a lower portion, the respective arm pivot being located in the upper portion, and the lower portion being located further than the upper portion is located from the grapple head, the lower portion having an inner side and an outer side, the inner side being closer than the outer side to the vertical center line; and wherein a wedge-shaped knife is located in the lower portion, the knife having a tapered, thin edge that is closer to the vertical center line than any other part of the knife.

14. The tie plate picker of claim 13, wherein the knife comprises a permanent upper portion and a replaceable lower portion.

15. The tie plate picker of claim 13, wherein the at least one of the two arms comprises two substantially parallel plates, each of the two plates being substantially parallel to the plane of operation, and the knife being located between the two plates.

16. The tie plate picker of claim 15, wherein the inner side of at least one of the two plates comprises an edge with an uneven surface.

17. The tie plate picker of claim 16, wherein the uneven surface is selected from a group consisting of teeth, a corrugated surface, a sawtooth surface, a grooved surface, and a knurled surface.

18. A grapple comprising;

a tie plate picker, the tie plate picker comprising;

a grapple head, extending in two, opposite directions from a vertical center line, the two opposite directions and the vertical center line defining a plane of operation;

two arms, each of the two arms pivotally depending from the gyapple head about respective arm pivots, allowing the two arms to rotate in directions substantially parallel to the plane of operation;

two cylinders, each of the two cylinders having a first end and an opposing second end, each of the two cylinders pivotally depending from the grapple head about respective cylinder pivots, allowing the two cylinders to rotate in directions substantially parallel to the Plane of operation, the cylinder pivot of each one of the respective c hinders being located generally at the first end of the respective cylinder; and two pistons, each of the two pistons moveably located within a respective one of the two cylinders, allowing a pivot end of each of the two pistons to extend out from and to retract in toward the second end of the respective one of the two cylinders, the pivot end of each of the pistons being pivotally connected to a respective one of the two arms about respective piston pivots;

wherein the arm pivots, the cylinder pivots, and the piston pivots are arranged relative to each other so that, when the pivot ends of the two pistons are extending out from the second ends of the respective cylinders, each of the two arms rotates in directions toward the vertical center line and the pivot end of each of the two respective pistons always moves in directions toward the vertical center line; and a rotator, the tie plate picker depending from the rotator, and the rotator allowing the plane of operation to rotate about the vertical center line.

* * * * *